US010927692B2

(12) United States Patent
Jones et al.

(10) Patent No.: US 10,927,692 B2
(45) Date of Patent: Feb. 23, 2021

(54) TURBOMACHINERY SEALING APPARATUS AND METHOD

(71) Applicant: General Electric Company, Schenectady, NY (US)

(72) Inventors: Ryan Christopher Jones, West Chester, OH (US); Daniel Endecott Osgood, Cincinnati, OH (US); Zachary Daniel Webster, Cincinnati, OH (US); Gregory T. Garay, West Chester, OH (US); Tingfan Pang, West Chester, OH (US)

(73) Assignee: General Electric Company, Schenectady, NY (US)

( * ) Notice: Subject to any disclaimer, the term of this patent is extended or adjusted under 35 U.S.C. 154(b) by 143 days.

(21) Appl. No.: 16/055,987

(22) Filed: Aug. 6, 2018

(65) Prior Publication Data

US 2020/0040753 A1 Feb. 6, 2020

(51) Int. Cl.
*F01D 9/04* (2006.01)
*F01D 11/00* (2006.01)

(52) U.S. Cl.
CPC ..... *F01D 11/006* (2013.01); *F01D 9/04* (2013.01); *F05D 2230/211* (2013.01); *F05D 2240/11* (2013.01); *F05D 2240/128* (2013.01); *F05D 2240/55* (2013.01)

(58) Field of Classification Search
CPC ..... F01D 11/006; F01D 9/04; F01D 11/005; F05D 2230/211; F05D 2240/11; F05D 2240/128; F05D 2240/55
See application file for complete search history.

(56) References Cited

U.S. PATENT DOCUMENTS 3,393,894 A * 7/1968 Redsell ..... F01D 9/042 416/47
3,728,041 A * 4/1973 Bertelson ..... F01D 9/042 415/189
3,752,598 A * 8/1973 Bowers ..... F01D 11/006 415/115
3,970,318 A * 7/1976 Tuley ..... F01D 11/005 277/641
4,063,845 A * 12/1977 Allen ..... F01D 11/005 415/134
4,524,980 A * 6/1985 Lillibridge ..... F01D 11/008 277/641
4,902,198 A * 2/1990 North ..... F01D 11/008 415/115
5,154,577 A * 10/1992 Kellock ..... F01D 11/005 277/641
5,531,457 A * 7/1996 Tibbott ..... F01D 11/006 277/590
5,735,671 A * 4/1998 Brauer ..... F01D 5/081 416/95

(Continued)

FOREIGN PATENT DOCUMENTS

EP 2335846 6/2011

*Primary Examiner* — Christopher Verdier
*Assistant Examiner* — Theodore C Ribadeneyra
(74) *Attorney, Agent, or Firm* — McGarry Bair PC

(57) ABSTRACT

A turbomachinery sealing apparatus including a first turbomachinery component having a first end face, and a seal extending away from the first end face, the seal being connected to a wall of the component by a tab extending between the wall and the seal.

17 Claims, 8 Drawing Sheets

(56) References Cited

U.S. PATENT DOCUMENTS 5,827,047 A * 10/1998 Gonsor ..... F01D 5/22 416/193 A
5,997,247 A * 12/1999 Arraitz ..... F01D 11/005 277/543
6,261,053 B1 * 7/2001 Anderson ..... F01D 25/12 415/115
6,712,581 B2 * 3/2004 Florjancic ..... B23P 13/00 29/557
6,883,807 B2 * 4/2005 Smed ..... F01D 11/005 277/641
7,121,800 B2 10/2006 Beattie
7,445,425 B2 * 11/2008 Ferra ..... F01D 9/042 415/134
7,562,880 B2 * 7/2009 Paprotna ..... F16J 15/322 277/644
7,887,286 B2 * 2/2011 Abgrall ..... F01D 5/225 277/647
7,918,265 B2 4/2011 Verner et al.
8,182,208 B2 * 5/2012 Bridges, Jr. ..... F01D 9/041 277/630
8,276,649 B2 10/2012 Gagnon, Jr. et al.
8,684,673 B2 * 4/2014 Salazar ..... F01D 11/005 277/644
8,807,198 B2 8/2014 Bullied et al.
8,845,285 B2 * 9/2014 Weber ..... F01D 11/005 415/191
8,905,708 B2 * 12/2014 Weber ..... F01D 11/005 415/110
9,403,208 B2 8/2016 Propheter-Hinckley
9,534,500 B2 * 1/2017 Bouchard ..... F01D 9/04
9,822,658 B2 * 11/2017 Lewis ..... F01D 11/08
9,945,484 B2 * 4/2018 Moehrle ..... F01D 11/003
10,443,419 B2 * 10/2019 Thomas ..... F01D 11/08
10,557,360 B2 * 2/2020 Boeke ..... F01D 11/005
10,648,362 B2 * 5/2020 Groves, II ..... F01D 11/003
2004/0051254 A1 * 3/2004 Smed ..... F01D 11/005 277/628
2006/0182624 A1 * 8/2006 London ..... F01D 11/008 415/170.1
2009/0097980 A1 * 4/2009 Hayasaka ..... F01D 11/006 416/189
2009/0269188 A1 * 10/2009 Martin ..... F01D 11/005 415/173.1
2010/0040479 A1 * 2/2010 Spangler ..... F01D 11/006 416/97 R
2010/0129211 A1 * 5/2010 Hart ..... F01D 25/246 415/209.3
2012/0219405 A1 * 8/2012 Szwedowicz ..... F16J 15/0887 415/173.3
2015/0361814 A1 * 12/2015 Bluck ..... F01D 11/006 416/183
2016/0074933 A1 3/2016 Bullied et al.
2016/0177788 A1 6/2016 Farah et al.
2016/0298480 A1 * 10/2016 Bluck ..... F01D 5/02
2016/0326898 A1 * 11/2016 Mongillo, Jr. ..... F01D 11/006
2016/0333712 A1 * 11/2016 Boeke ..... F01D 11/006

* cited by examiner

TURBOMACHINERY SEALING APPARATUS AND METHOD

BACKGROUND OF THE INVENTION

This invention relates generally to sealing leakage paths in an engine. More particularly, the invention relates to seals, such as spline seals, used in leakage paths of turbine hardware or other hardware where seals are used to seal leaks between components.

Both stationary and rotating turbine engine components such as turbine stators or nozzles, blades, blade shrouds, and combustors are often configured as a ring of side-by-side segments. It is known that leakage at gaps between adjacent segments leads to inefficiencies in aircraft engines. As such, air leakage between adjacent segments must be minimized in order to meet engine performance requirements. This is often accomplished using spline seals which are small metallic strips that are received in seal slots formed in two adjacent segments, bridging the gaps therebetween. Each of the slots formed in the adjacent segments accepts one-half of the spline seal.

In traditional seal assembly, sealing leakage paths requires tedious assembly and provides a lot of opportunity to misplace seals and/or install seals incorrectly due to assembling a plurality of modules where numerous seals must be carefully inserted to seal each of the leakage paths. For example, in a ring of turbine blades or a ring of stationary turbine nozzles or a ring of turbine shrouds, there might be between 30 and 70 joint lines, each one having a seal. Assembling all of the seals is complex and time-consuming.

The problem with the prior art is that the complex nature of installing the seals may result in misplaced and/or incorrectly installed seals, resulting in air leakage between adjacent segments and a loss of efficiency. Even when installed correctly, sealing effectiveness and flow control could be improved.

BRIEF DESCRIPTION OF THE INVENTION

At least one of the above-noted problems is addressed by the use of seals that are cast-in and/or manufactured by other manufacturing methods that permit the seals to be connected to and/or integrally formed with one of the adjacent segments and permit the seals to remain in position during assembly of the adjacent segments, thereby preventing misplaced and/or incorrect installation of the seals.

According to one aspect of the technology described herein, a turbomachinery sealing apparatus including a first turbomachinery component having a first end face, and a seal extending away from the first end face, the seal being connected to a wall of the component by a tab extending between the wall and the seal.

According to another aspect of the technology described herein, A method of assembling a turbomachinery sealing apparatus includes the steps of: providing a first turbomachinery component, the first turbomachinery component having a seal connected thereto by a tab; providing a second turbomachinery component; and positioning the first and second turbomachinery components adjacent each other such that the seal spans a gap between the two turbomachinery components.

According to another aspect of the technology described herein, a method of assembling a turbomachinery component includes the steps of: providing a plurality of turbomachinery segments, each of the plurality of turbomachinery segments having a first end face and a second end face opposite the first end face, the first end face including a first seal slot and the second end face including a second seal slot, the first seal slot having a seal disposed therein, the seal being connected to a wall of the first seal slot by a tab extending between the wall and the seal; and arranging the plurality of turbomachinery segments with a first end face of one of the turbomachinery segments positioned adjacent to a second end face of an adjacent turbomachinery segment such that a portion of the respective seal extends into the second seal slot.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
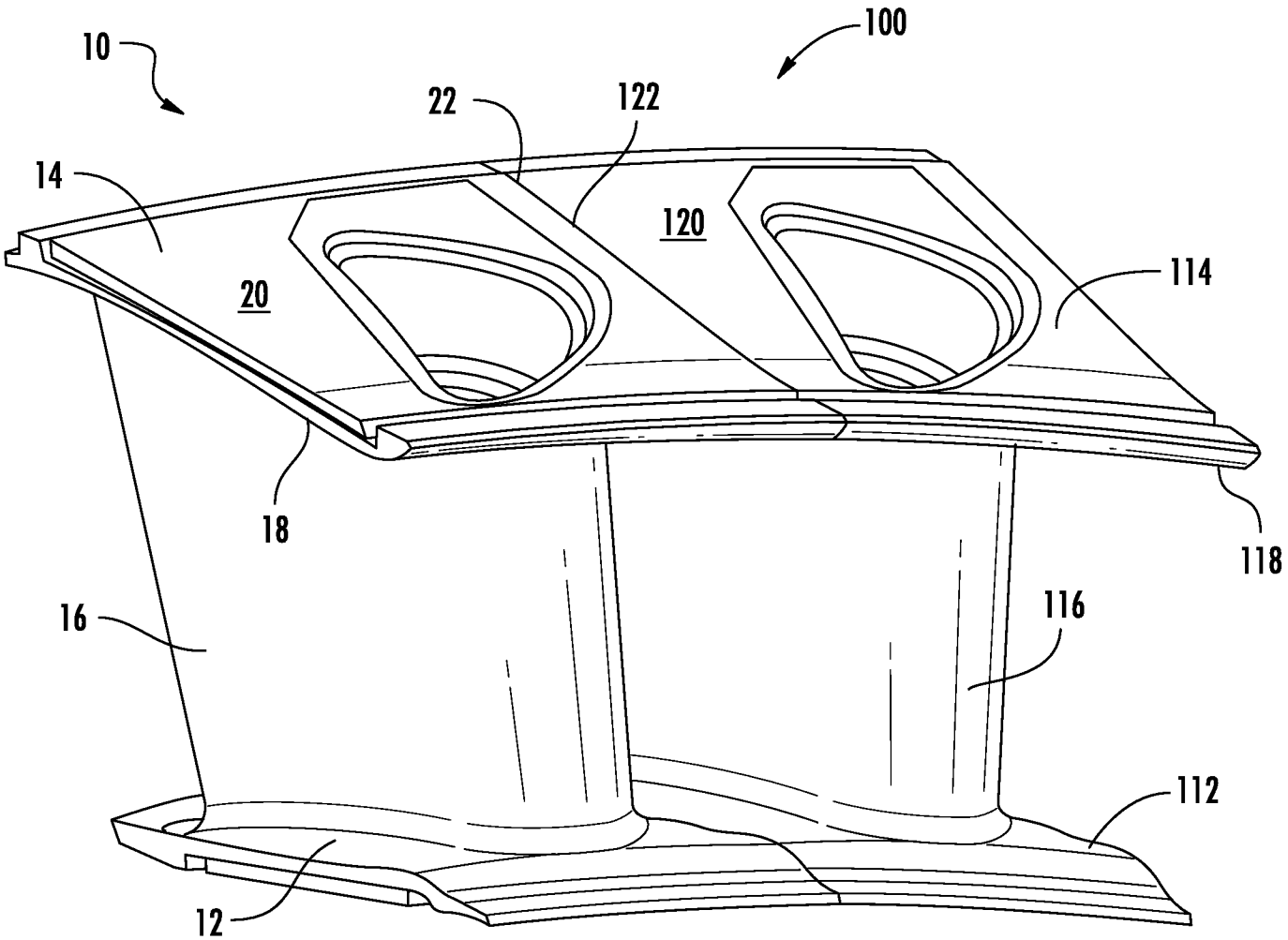
FIG. 1 is a perspective view of two nozzle segments assembled together.
Figure 2:
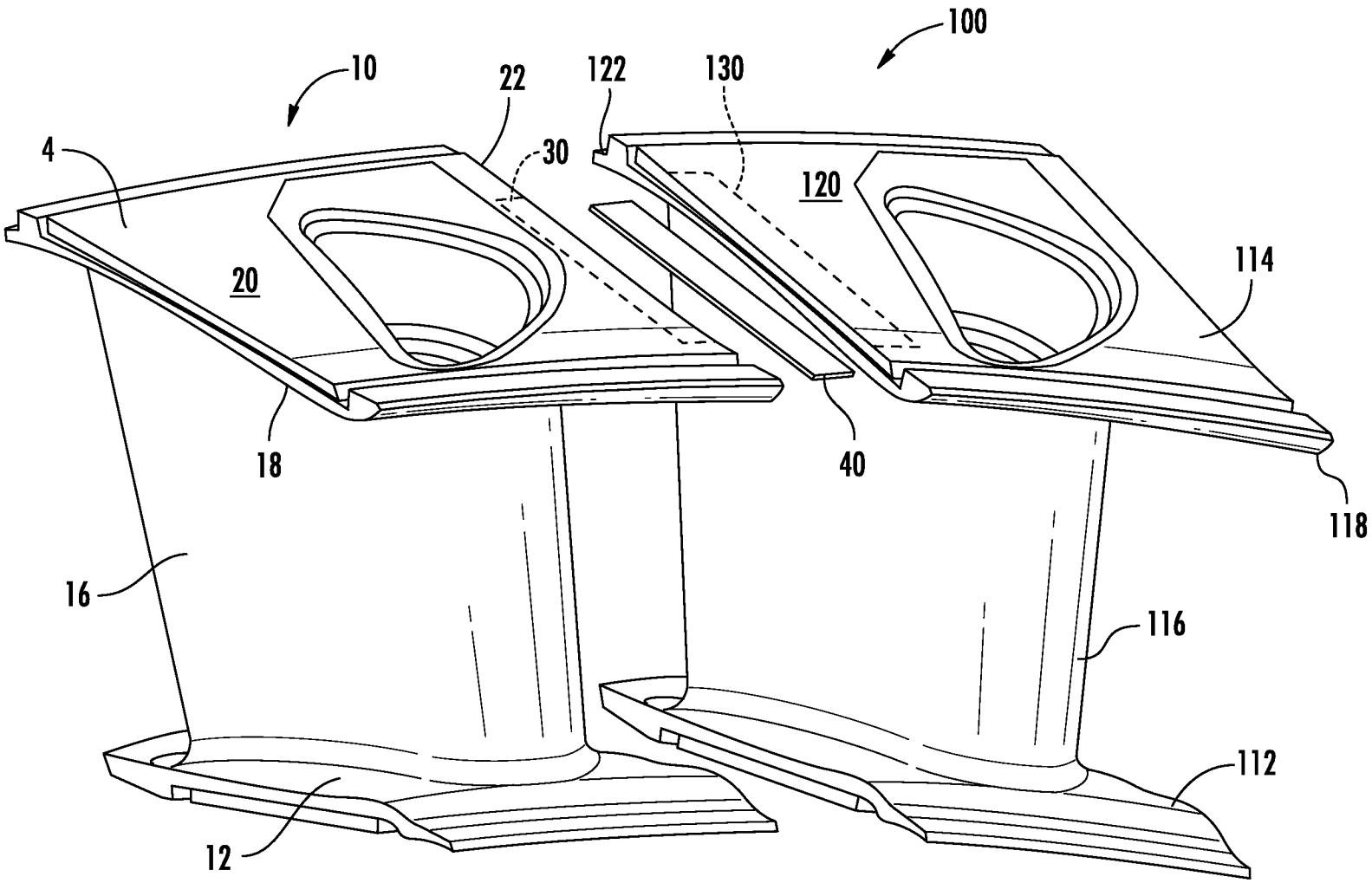
FIG. 2 is an exploded perspective view of FIG. 1 showing a spline seal and seal slots for sealing a leakage path of the assembled nozzle segments.

Referring to the drawings wherein identical reference numerals denote the same elements throughout the various views, FIG. 1 depicts two exemplary turbine nozzle segments 10, 100 secured together to form a portion of a turbine nozzle in a gas turbine engine. The turbine nozzle is just one example of numerous assemblies of turbomachinery components within a gas turbine engine or similar turbomachine in which an annular assembly is built up from two or more components which have a gap therebetween requiring sealing. These are referred to herein as "sealing assemblies". Such assemblies could be located anywhere in the engine and are not limited to a particular module. Such assemblies are often, but not always, built up from a ring of individual arcuate segments. Non-limiting examples of components or segments making up sealing assemblies include the inner or outer bands of stationary airfoil vanes, the platforms of turbomachinery blades, or the ends of shroud segments.

The first nozzle segment 10 includes an inner band 12 that is connected to an outer band 14 by an airfoil 16. The outer band 14 has an inboard surface 18 and an outboard surface 20. An end face 22 of the outer band 14 is positioned between the inboard surface 18 and the outboard surface 20.

Likewise, second nozzle segment 100 includes an inner band 112 that is connected to an outer band 114 by an airfoil 116. The outer band 114 has an inboard surface 118 and an outboard surface 120. An end face 122 of the outer band 114 is positioned between the inboard surface 118 and the outboard surface 120.

Referring now to FIGS. 2-6, each of the end faces 22 and 122 include a seal slot 30 and 130, respectively, extending inwardly from the end faces 22, 122 and configured to receive a spline seal 40 therein. As seen in FIGS. 3-6, when a ring or annular array of turbine nozzle segments 10, 100 is assembled, the end faces 22, 122 lie in close proximity to each other in a facing relationship with a small gap "G" defined therebetween. The spline seal 40 is received in the seal slots 30, 130 of the adjacent segments 10, 100 and spans the gap G. Typically, the spline seal 40 is a thin, plate-like member of metal stock with opposed outer and inner surfaces 42, 44 respectively. The function of the spline seal 40 is to prevent air leakage through gap G.

The seal slot 30 is defined by a bottom wall 32, an inboard wall 34, and an outboard wall 36 and is enclosed by two end walls (not shown). Inboard wall 34 and outboard wall 36 extend from the bottom wall 32 to a rim 38 at the end face 22.

Likewise, seal slot 130 is defined by a bottom wall 132, an inboard wall 134, and an outboard wall 136 and is enclosed by two end walls (not shown). The inboard wall 134 and the outboard wall 136 extend from the bottom wall 132 to a rim 138 at the end face 122.

The seal slots 30, 130 have a basic depth D, defined by its shallowest portion, which represents a desired seating depth of the corresponding spline seal 40. For example, the seating depth D may be on the order of one-half of the total width W of the spline seal 40. When assembled, the spline seal 40 essentially fills the entire volume of the seal slots 30, 130.

Figure 3:
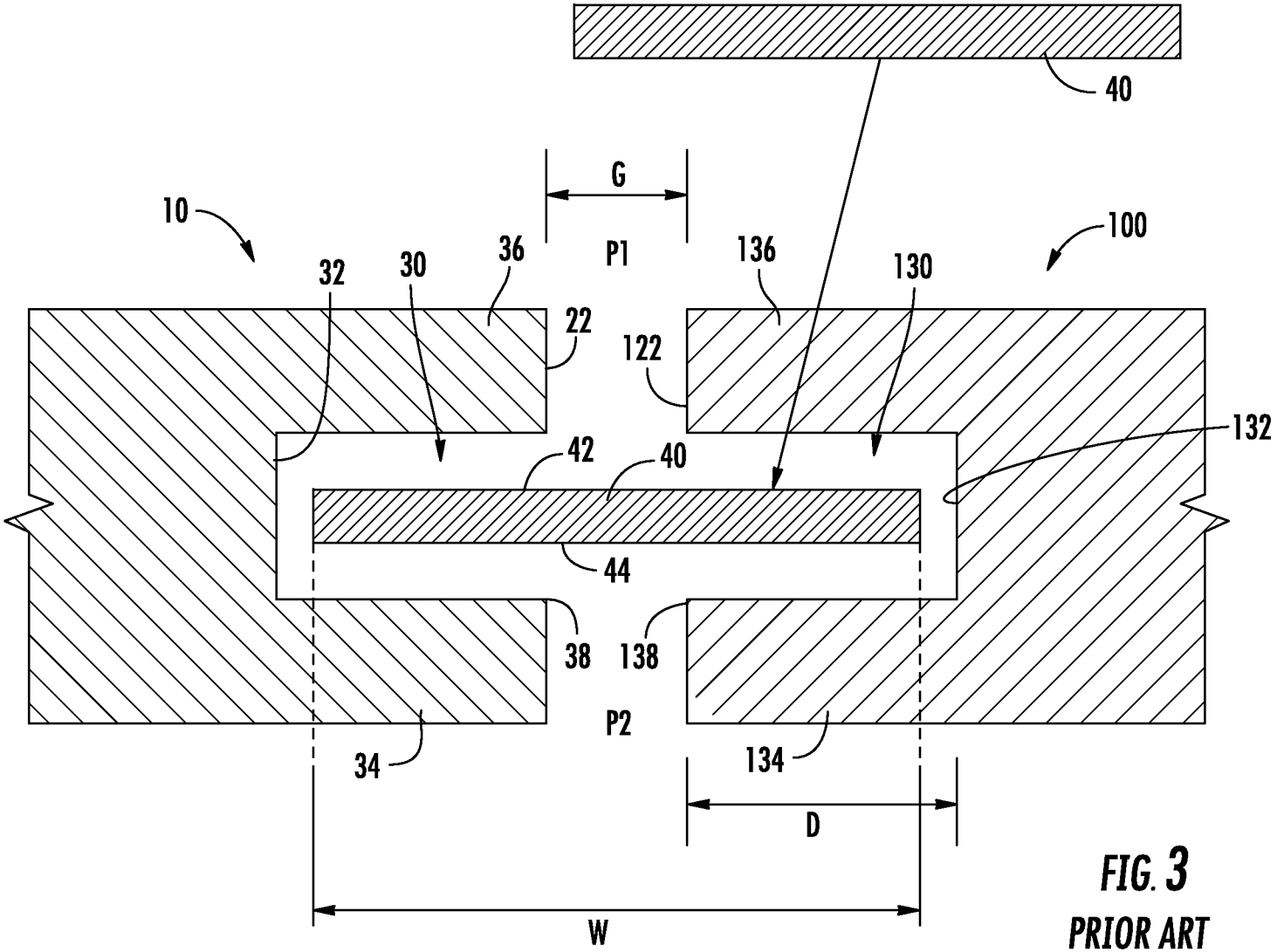
FIG. 3 PRIOR ART
FIG. 3 is a cross-sectional view of FIG. 1 showing a prior art method of assembling the two nozzle segments.

As shown in FIG. 3, current art methods of assembly require the seal 40 to be inserted into slots 30, 130 and then secure the segments 10, 100 together. The purpose of the seal 40 is to prevent air leakage from the area labeled "P1" to the area labeled "P2". In practice, the pressure differential between P1 and P2 causes the inner surface 44 of the seal 40 to bear against the inboard walls 34, 134 of each of the slots 30, 130, thus blocking flow. Generally, a clearance of about 0.254 mm (0.010 in) between the outer surface 42 and outboard walls 36, 136 and about 0.254 mm (0.010 in) between the inner surface 44 of the seal 40 and the inboard walls 34, 134 is provided. There is some inconsistency in how the seal 40 operates because it can move around in the slot 30, 130 until the pressure differential causes the seal 40 to settle against the inboard walls 34,134.

Note, in general the area labeled "P1" is part of a secondary flowpath i.e., it is on the "cold side" of the hardware. The area labeled "P2" is part of the primary flowpath, i.e., is on the "hot side" of the hardware where the hot combustion gases are flowing. The seal 40 prevents the hot combustion gases from flowing into the secondary flowpath. Generally, the pressure differential is maintained to provide a backflow margin, i.e., to make sure that hot flowpath gases are not ingested into the secondary flowpath even if the seal 40 is not complete. Accordingly, there are instances in which it is desirable to minimize a purge flow, and the ability to meter the flow using the seal would be helpful. As discussed above, such assembly is complex and tedious due to the number of seals and segments being assembled and due to seals being misplaced and/or incorrectly installed.

Figure 4:
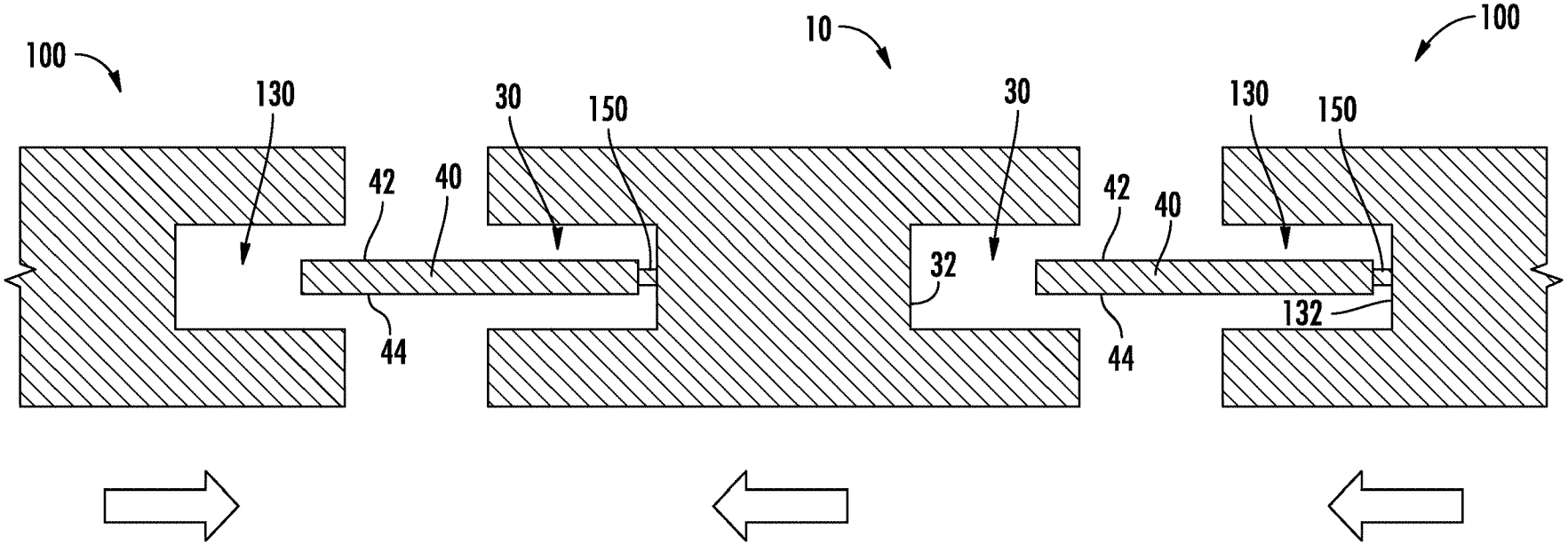
FIG. 4 is a cross-sectional view showing an exemplary method of assembling a plurality of nozzle segments.
Figure 5:
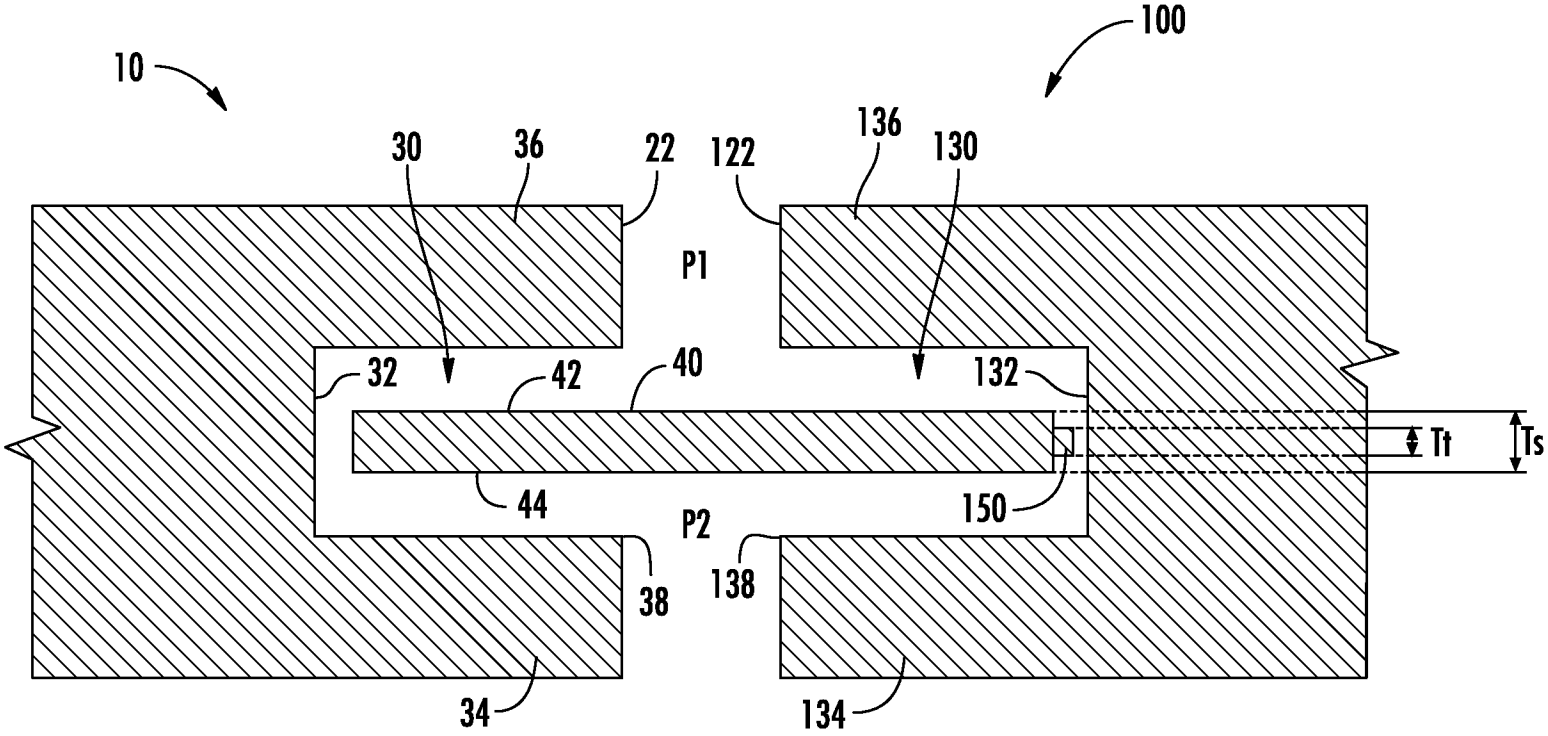
FIG. 5 illustrates a seal installed in seal slots of adjacent nozzle segments after assembly using the method of FIG. 4 where the seal is separated from the seal slots after assembly.
Figure 6:
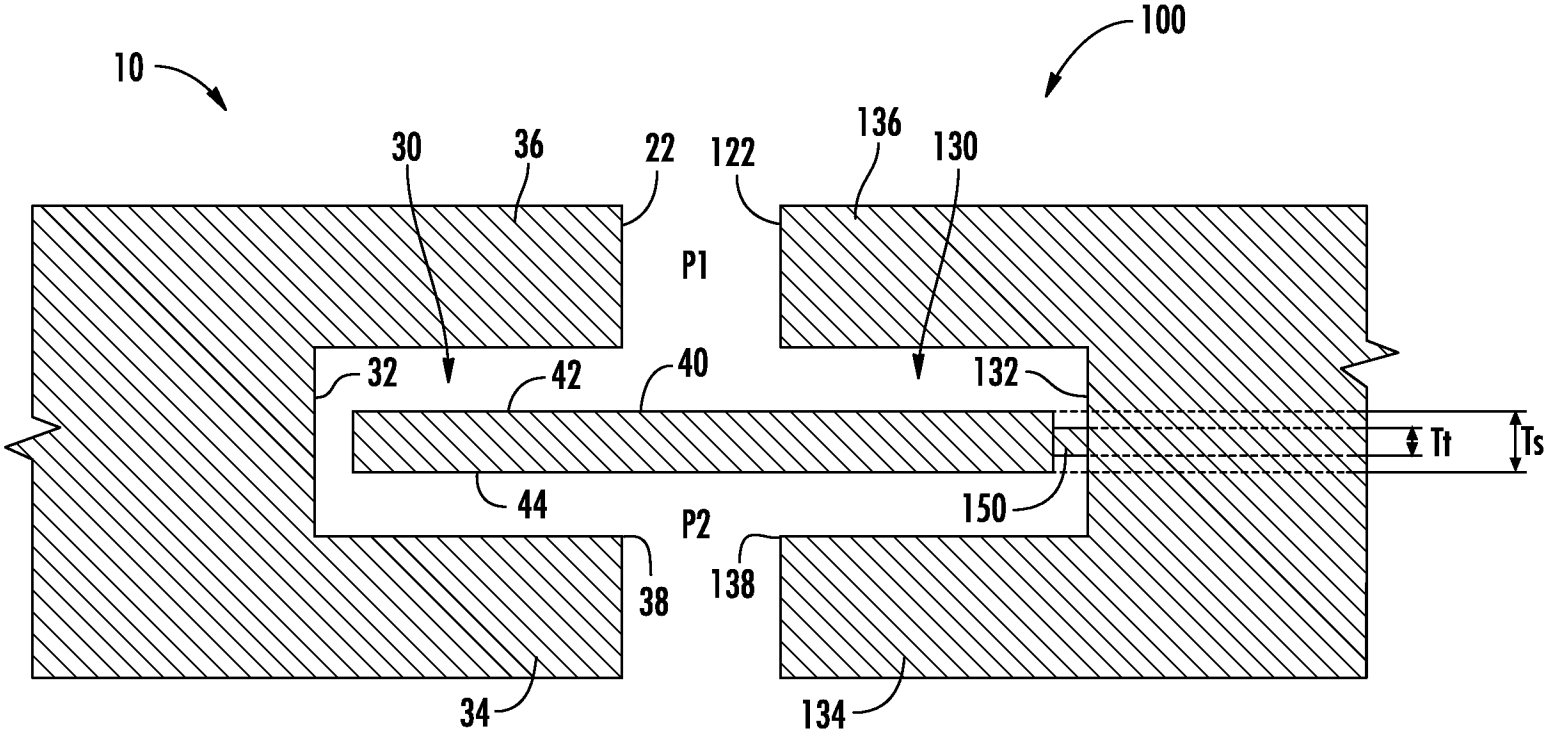
FIG. 6 illustrates a seal installed in seal slots of adjacent nozzle segments after assembly using the method of FIG. 4 where the seal remains connected to one of the seal slots.

Referring to FIGS. 4-6, the present concept uses manufacturing technologies such as investment casting, additive manufacturing, and electro discharge machining (EDM) to form the slots 30, 130 and seal 40. This results in the seal 40 being integrally formed with (i.e., of unitary or monolithic construction) or secured to one of the slots 30, 130 and allows adjacent segments 10, 100 to be secured together without the need to manually insert the seal 40 into slots 30, 130. Such manufacturing also allows for tolerances between the slots 30, 130 and seal 40 to be more tightly controlled to provide for better sealing effectiveness and drive flow away from potential leakage paths. FIG. 4 shows turbine nozzle segments 10, 100 being assembled together with seals 40 connected to adjacent ones of the turbine nozzle segments 10, 100. This method eliminates the need for seal assembly which can be complex.

As illustrated, the seal 40 is connected to bottom wall 32, 132 of slot 30, 130 by a tab or sprue 150 between the seal 40 and bottom wall 32, 132. As used herein, the term "connected" when describing two elements refers to a joining or interconnection between those elements, and not merely contact (e.g., friction, pressure) between the two. As used herein the term "tab" refers to a relatively slender mechanical interconnecting element, which need not have any particular cross-sectional shape. Synonyms for the term "tab" include, for example: sprue, ligament, connector, or beam. As shown, the tab or sprue 150 has a thickness "$T_t$" less than a thickness "$T_s$" of the seal 40. It should be appreciated, instead of seal 40 being connected to bottom wall 32, 132, seal 40 may be connected by one or more tabs to one or more of the inboard wall 34, the outboard wall 36, the inboard wall 134, or the outboard wall 136 so long as the seal 40 is connected to at least one of the walls of the slots 30, 130 to allow assembly of adjacent turbine nozzle segments 10, 100.

The tab or sprue 150 may operate in different ways. For example, the tab or sprue 150 may be very thin and/or otherwise breakable. Its purpose would be to fixture the seal 40 in place to make assembly easier. So, for example two turbine nozzle segments 10, 100 could be assembled together with one of the turbine nozzle segments 10, 100 having the integrated seal 40. Then once they were assembled, a tool could be used to break off or knock apart the seal to free it (could be done by pin strike or cutting/grinding tool), FIG. 5. This method could be used with many seal types and even dampers on turbine blades.

Figure 7:
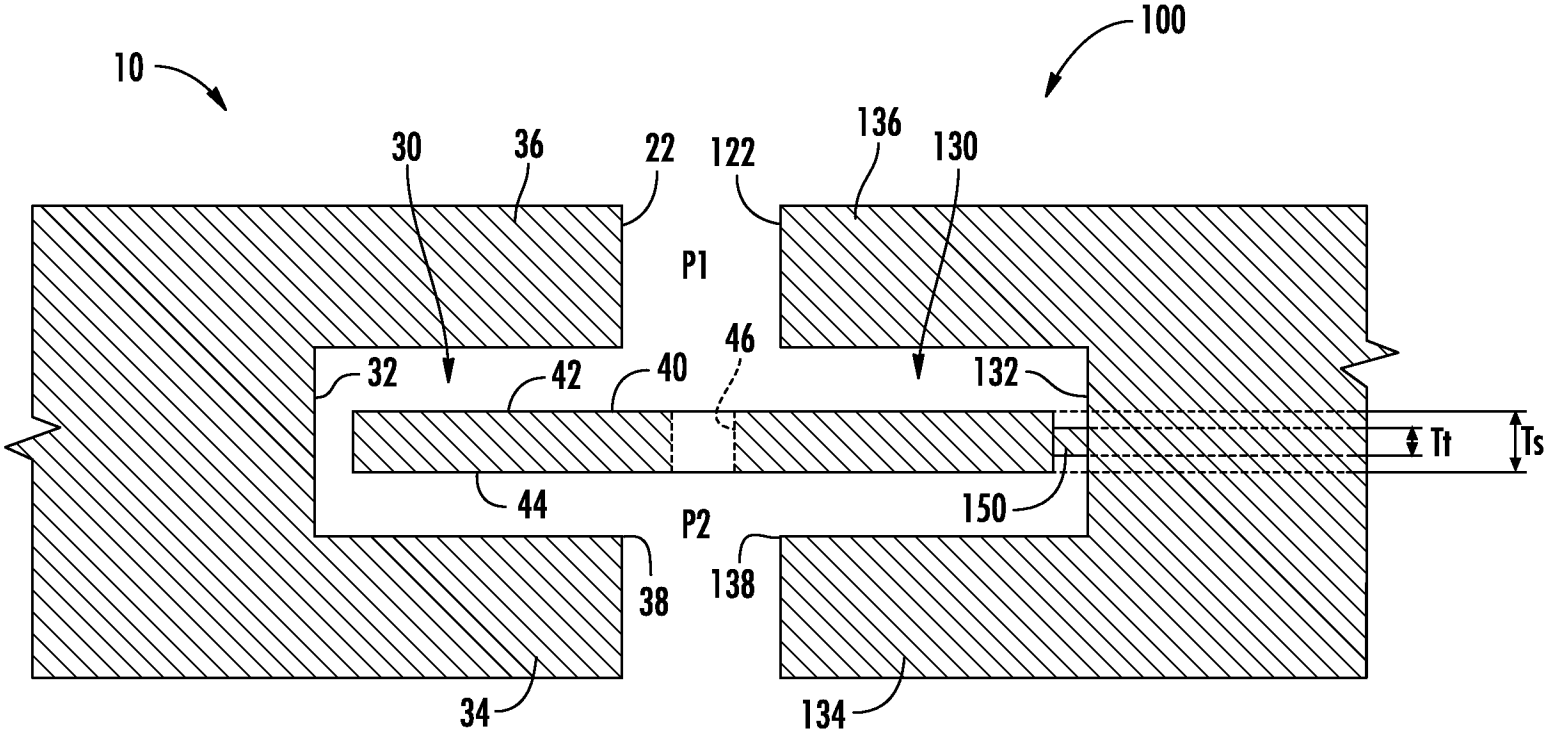
FIG. 7 illustrates a seal installed in seal slots of adjacent nozzle segments after assembly using the method of FIG. 4 where the seal remains connected to one of the seal slots and includes at least one aperture.

In another example, FIG. 6, the tab or sprue 150 may be slightly thicker to hold the seal 40 in place but allow it to move around to seek a sealing position in the slot 30, 130. In this example, the tab or sprue 150 would be connected to the bottom wall 32, 132 and would not be broken off and would act like a spring element to provide a spring force opposing the pressure differential force between opposing outer and inner surfaces 42, 44 of the seal 40, thereby providing a variable restriction which would allow leakage flow to be metered. Further, the seal 40 may include apertures or slots 46, FIG. 7, formed through its thickness to permit metering of purge flow when the seal 40 is in a completely sealed position, e.g. the seal 40 prevents leakage flow.

Figure 9:
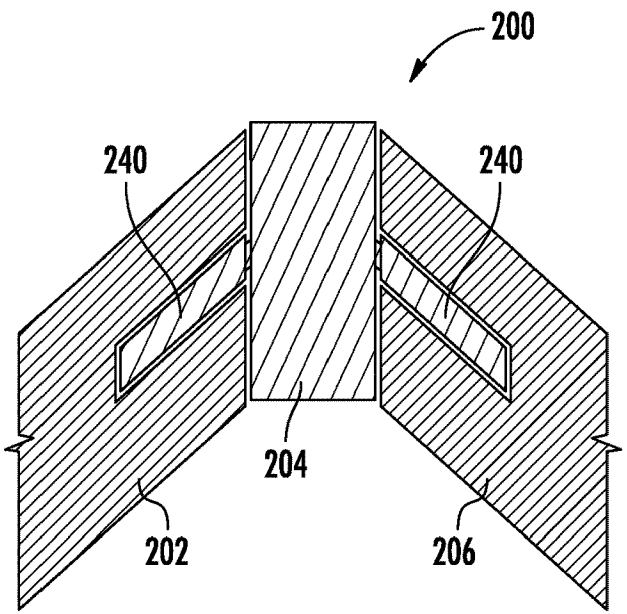
FIG. 9 is an assembled view of the components of FIG. 8.
Figure 8:
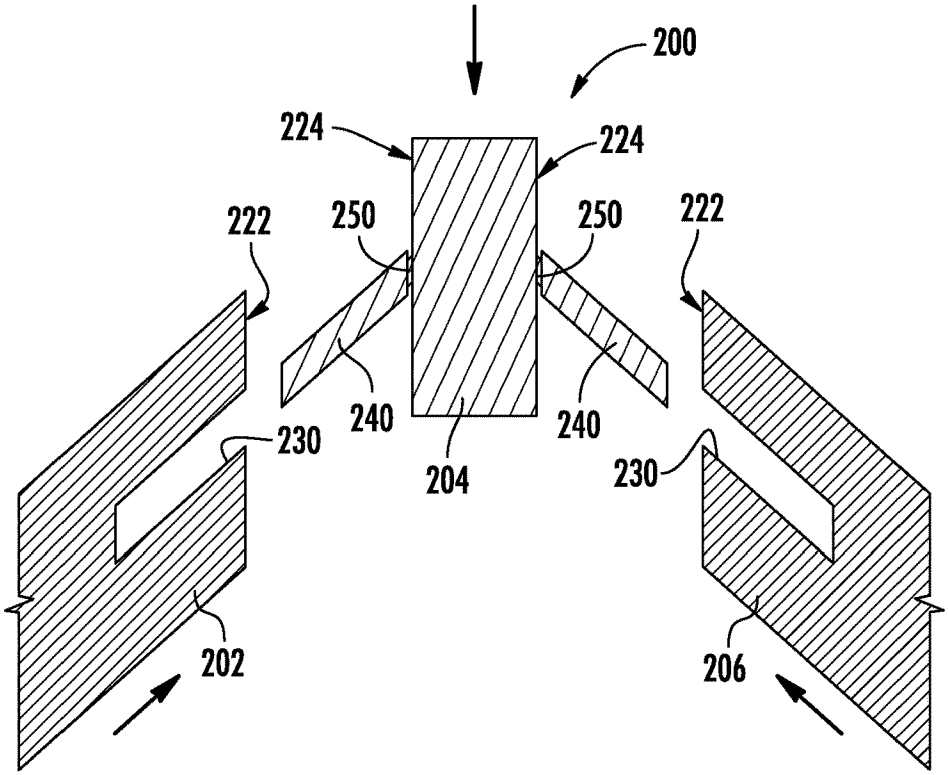
FIG. 8 is an exploded schematic view showing an alternative seal embodiment in which a component has seals extending from opposite faces thereof.

Numerous physical configurations of the seal structure described above are possible. For example, FIGS. 8 and 9 illustrate an assembly 200 comprising first, second, and third components 202, 204, 206 respectively. The first and third components 202, 206 each include an end face 222 having a seal slot 230 formed therein. In the illustrated example, each seal slot 230 extends an oblique angle from the respective end face 222. In the as-assembled orientation, the seal slots 230 are angled opposite to each other.

The second component 204 has end faces 224 on opposite sides thereof, each having a seal 240 connected thereto by a tab 250. The tab 250 may have a thickness less than a thickness of the seal 240. In this example, the seals 240 extend away from the end faces 224 at an oblique angle, defining a rough V-shape in a front or rear elevation view.

The components 202, 204, and 206 may be assembled by moving them in the direction of the arrows, namely in a combination of axial and lateral movements. FIG. 9 shows the components 202, 204, and 206 in an assembled condition with each of the seals 240 received in one of the seal slots 230.

The embodiment of FIGS. 8 and 9 illustrates the concept that a seal connected by a tab as described above may extend from a face of one component and be fully received in a slot of the meeting component; or, stated another way, it is not necessary for each of the components to include a seal slot. This embodiment further illustrates the concept that a given component may have two or more seals extending from opposing sides thereof, which are received in slots of two adjacent components. The provision of the seals extending at oblique angles permits physical assembly of a generally angled or arcuate structure from these components.

The current technology provides the benefits of eliminating assembly steps, simplifying the overall assembly process, and allowing for tightly controlled manufacturing tolerances to introduce better sealing effectiveness and drive flow away from potential leakage paths; thus, improving performance.

The foregoing has described a turbomachinery apparatus and method. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A turbomachinery sealing apparatus, comprising a first turbomachinery component having a first end face, and a seal extending away from the first end face, the seal being connected to a wall of the component by a tab extending between the wall and the seal, wherein the seal, tab, and wall form a monolithic structure.

2. The apparatus of claim 1, wherein the wall defines a portion of a first seal slot communicating with the first end face, and a portion of the seal is received in the first seal slot.

3. The apparatus of claim 2, further including a second turbomachinery component disposed adjacent to the first turbomachinery component, the second turbomachinery component having a second end face and a second seal slot formed in the second end face, wherein when the first and second turbomachinery components are disposed adjacent to each other, and a portion of the seal extends into the second seal slot to seal off a gap between the first and second end faces.

4. The apparatus of claim 2, wherein the first turbomachinery component includes a second end face opposite the first end face, the second end face including a second seal slot.

5. A turbomachinery sealing apparatus including a plurality of the first turbomachinery components according to claim 4 arranged in a ring, with the first end face of each of the first turbomachinery components disposed adjacent to the second end face of an adjacent one of the first turbomachinery components, such that a portion of the seal of each of the first turbomachinery components extends into the second seal slot of one of the first turbomachinery components, thereby sealing off a gap between adjacent ones of the plurality of the first turbomachinery components.

6. The apparatus of claim 1 wherein the seal extends away from the first end face at an oblique angle.

7. The apparatus of claim 1, wherein the tab has a thickness less than a thickness of the seal.

8. The apparatus of claim 1, wherein the seal includes a metering aperture formed therethrough.

9. A method of assembling a turbomachinery sealing apparatus, comprising the steps of:

providing a first turbomachinery component, the first turbomachinery component having a seal connected thereto by a tab;

providing a second turbomachinery component;

positioning the first and second turbomachinery components adjacent each other such that the seal spans a gap between the first and second turbomachinery components; and breaking the tab after positioning the first and second turbomachinery components.

10. The method of claim 9, wherein the seal, tab, and first turbomachinery component form a monolithic structure.

11. The method according to claim 9, wherein the first turbomachinery component includes a first end face having a first seal slot formed therein.

12. The method according to claim 11, wherein the seal is disposed within the first seal slot and connected to a wall of the first seal slot by the tab.

13. The method according to claim 12, wherein the second turbomachinery component includes a second end face having a second seal slot formed therein.

14. The method according to claim 13, further including the step of positioning the first end face adjacent to the second end face to permit a portion of the seal to be positioned in the second seal slot.

15. The method according to claim 9, wherein the seal includes a metering aperture.

16. A method of assembling a turbomachinery component, comprising the steps of:

providing a plurality of turbomachinery segments, each of the plurality of turbomachinery segments having a first end face and a second end face opposite the first end face, the first end face including a first seal slot and the second end face including a second seal slot, the first seal slot having a seal disposed therein, the seal being connected to a wall of the first seal slot by a tab extending between the wall and the seal;

arranging the plurality of turbomachinery segments with a first end face of one of the turbomachinery segments positioned adjacent to a second end face of an adjacent turbomachinery segment such that a portion of the respective seal extends into the second seal slot; and breaking the tab after arranging the plurality of turbomachinery segments.

17. The method according to claim 16, wherein the seal, tab, and turbomachinery segment form a monolithic structure.

* * * * *